US008488796B2

(12) United States Patent
Jot et al.

(10) Patent No.: US 8,488,796 B2
(45) Date of Patent: Jul. 16, 2013

(54) 3D AUDIO RENDERER

(75) Inventors: Jean-Marc Jot, Aptos, CA (US); Martin Walsh, Scotts Valley, CA (US); Adam R. Philp, Twickenham (GB)

(73) Assignee: Creative Technology Ltd, Singapore (SG)

( * ) Notice: Subject to any disclaimer, the term of this patent is extended or adjusted under 35 U.S.C. 154(b) by 1556 days.

(21) Appl. No.: 11/836,137

(22) Filed: Aug. 8, 2007

(65) Prior Publication Data

US 2008/0037796 A1 Feb. 14, 2008

Related U.S. Application Data

(60) Provisional application No. 60/821,815, filed on Aug. 8, 2006.

(51) Int. Cl.
*H04R 5/00* (2006.01)

(52) U.S. Cl.
USPC ..... 381/17; 381/310; 381/309; 381/18; 381/22; 381/23; 381/28; 700/94

(58) Field of Classification Search
USPC ..... 381/310, 309, 18, 22, 23, 17, 28
See application file for complete search history.

(56) References Cited

U.S. PATENT DOCUMENTS

| | | | | |
|---|---|---|---|---|
| 5,491,754 | A * | 2/1996 | Jot et al. | 381/63 |
| 6,011,851 | A * | 1/2000 | Connor et al. | 381/17 |
| 6,035,045 | A * | 3/2000 | Fujita et al. | 381/17 |
| 6,078,669 | A * | 6/2000 | Maher | 381/17 |
| 6,111,958 | A * | 8/2000 | Maher | 381/17 |
| 6,498,857 | B1 * | 12/2002 | Sibbald | 381/310 |
| 6,507,658 | B1 * | 1/2003 | Abel et al. | 381/17 |
| 6,714,652 | B1 * | 3/2004 | Davis et al. | 381/17 |
| 7,174,229 | B1 * | 2/2007 | Chen et al. | 700/94 |
| 7,231,054 | B1 * | 6/2007 | Jot et al. | 381/310 |
| 7,356,465 | B2 * | 4/2008 | Tsingos et al. | 704/220 |
| 7,412,380 | B1 * | 8/2008 | Avendano et al. | 704/216 |
| 2006/0165184 | A1 * | 7/2006 | Purnhagen et al. | 375/242 |

OTHER PUBLICATIONS

Touimi et al , Efficient Method for Multiple Compressed Audio Streams Spatialization, MUM 2004 ,pp. 229-235.*

Potard et al, Control and Measurement of Apparent sound Source Width and its Applications to Sonification and Virtual Auditory Displays, ICAD 2004, Jul. 6-9, 2004.*

Tsingos et al, Perceptual Audio Rendering of Complex Virtual Environments, REVES/INRIA, 2004 , p. 249-258.*

Jean Marc Jot, Real Time Spatial Processing of Sounds for Music , Multimedia and interactive Human-Computer interfaces, ACM, 1997.*

Chandra et al; A Binaural Synthesis with Multiple Sound Sources Based on Spatial Features of Head-related Transfer Functions, IEEE, 2006.*

* cited by examiner

*Primary Examiner* — Davetta W Goins
*Assistant Examiner* — Kuassi Ganmavo
(74) *Attorney, Agent, or Firm* — Creative Technology Ltd

(57) ABSTRACT

A method for simulating spatially extended sound sources comprising: panning a first input signal over a plurality of output channels to generate a first multi-channel directionally encoded signal; panning a second input signal over the plurality of output channels to generate a second multi-channel directionally encoded signal; combining the first and second multi-channel directionally encoded signals to generate a plurality of loudspeaker output channels; and applying a bank of decorrelation filters on the loudspeaker output channels.

8 Claims, 8 Drawing Sheets

3D AUDIO RENDERER

CROSS-REFERENCES TO RELATED APPLICATIONS

This application claims priority from provisional U.S. Patent Application Ser. No. 60/821,815, filed Aug. 8, 2006, titled "3D Audio Renderer" the disclosure of which is incorporated by reference in its entirety.

BACKGROUND OF THE INVENTION

1. Field of the Invention

The present invention relates to signal processing techniques. More particularly, the present invention relates to methods for processing audio signals.

2. Description of the Related Art

Binaural or multi-channel spatialization processing of audio signals typically requires heavy processing costs for increasing the quality of the virtualization experience, especially for accurate 3-D positional audio rendering, for the incorporation of reverberation and reflections, or for rendering spatially extended sources. It is desirable to provide improved binaural and multi-channel spatialization processing algorithms and architectures while minimizing or reducing the associated additional processing costs.

In binaural 3-D positional audio rendering schemes, a fractional delay implementation is necessary in order to allow for continuous variation of the ITD according to the position of a virtual source. The first-order linear interpolation technique causes significant spectral inaccuracies at high frequencies (a low-pass filtering for non-integer delay values). Avoiding this artifact requires a more expensive fractional delay implementation. It is therefore desirable to provide new techniques for simulating continuous ITD variation that do not require interpolation or fractional delay implementation.

Binaural 3D audio simulation is generally based on the synthesis of primary sources that are point source emitters, i.e. which appear to emanate from a single direction in 3D auditory space. In real-world conditions, many sound sources generally approximate the behavior of point sources. However, some sound-emitting objects radiate acoustic energy from a finite surface area or volume whose dimensions render the point-source approximation unacceptable for realistic 3D audio simulation. Such sound-emitting objects may be more suitably represented as line source emitters (such as a vibrating violin string), area source emitters (such as a resonating panel) or volume source emitters (for example a waterfall).

In general, the position, shape and dimensions of a spatially extended source are specified and altered under program control, while an appropriate processing algorithm is applied to a monophonic input signal in order to simulate the spatial extent of the emitter. Two existing approaches to this problem include pseudo-stereo approaches and multi-source dynamic decorrelation approaches.

The goal of pseudo-stereo techniques is to create a pair of decorrelated signals from a monophonic audio input so as to increase the apparent width of the image when played back over two loudspeakers, compared to direct playback of the monophonic input. These techniques can be adapted to simulate spatially extended sources by panning and/or mixing the decorrelated signals. When applied to the 3D audio simulation of spatially extended sources, pseudo-stereo algorithms have three main limitations: they can generate audible artifacts including timbre coloration and phase distortion; they are designed to generate a pair of decorrelated signals, and are not suitable for generating higher numbers of decorrelated versions of the input signal; and they incur substantial per-source computational costs, as each monophonic source is individually processed to generate decorrelated versions prior to mixing or panning.

The multi-source dynamic decorrelation approach addresses some of the above limitations. Multiple decorrelated versions of a monophonic input signal are generated using an approach called dynamic decorrelation, which uses a different sparse FIR filter with different delays and coefficients to produce each decorrelated version of the input signal. The delays and coefficients are chosen such that the sum of the decorrelated versions is equal to the original input signal. The resulting decorrelated signals are individually spatialized in 3-D space to cover an area or volume that corresponds to the dimensions of the object being simulated. This technique is less prone to coloration and phase artifacts than prior pseudo-stereo approaches and less restrictive on the number of decorrelated sources that can be generated. Its main limitation is that it incurs substantial per-source computation costs. Not only must multiple decorrelated signals be generated for each object, but each resulting signal must then be spatialized individually. The amount of processing necessary to generate a spatially extended sound object is variable, as the number of decorrelated sources generated depends on factors including the spatial extent and shape of the object, as well as the audible angle subtended by the object with respect to the listener, which varies with its orientation and distance. It is desirable to provide new techniques for computationally efficient simulation of spatially extended sound sources.

SUMMARY OF THE INVENTION

The present invention provides a new method for simulating spatially extended sound sources. By using the techniques described herein, simulation of a spatially extended ("volumetric") sound source may be achieved for a computational cost comparable to that incurred by a normal point source. This is especially advantageous for implementations of this feature on resource-constrained platforms.

The invention provides in one embodiment a method for simulating spatially extended sound sources. A first input signal is panned over a plurality of output channels to generate a first multi-channel directionally encoded signal. A second input signal is panned over the plurality of output channels to generate a second multi-channel directionally encoded signal. The first and second multi-channel directionally encoded signals are combined to generate a plurality of loudspeaker output channels. A bank of decorrelation filters are applied on the loudspeaker output channels.

In accordance with variations of this embodiment, the plurality of loudspeakers comprises at least one of real or virtual loudspeakers. In accordance with another embodiment, the panning comprises deriving an energy scaling factor associated with each of the output channels. The spatially extended source comprises a plurality of notional elementary sources and the energy scaling factor is derived from the summation of contributions of at least one notional elementary source. The notional sources may have discrete panning weights assigned to them and the summation combines the panning weight contributions of the sources. In yet other embodiments, the at least one of the decorrelation filters may comprise any suitable filter including but not limited to one of an all-pass filter, a reverberation filter, a finite impulse response filter, a infinite impulse response filter, and a frequency-domain processing filter. The least a first and a second of the decorrelation filters may, in selected embodiments, have weakly correlated responses.

In accordance with another embodiment, a binaural encoding module for rendering the position of a sound source is provided. The binaural module is configured to generate at least one left signal and one right signal where at least one of these signals is delayed by an integer number of samples, the amount of the delay depending on the position of the sound source. The binaural module is further configured to update the rendered position of the sound source based on transitioning to a new integer delay value triggered by an updated position of the sound source.

In accordance with another embodiment, the rendering a moving sound source includes triggering multiple successive updates of the position of the sound source. In accordance with yet another embodiment at least one of the left signal and the right signal is delayed by reading signal samples first delay tap position in delay memory and transitioning to a new integer delay value is performed by selecting a second delay tap position in delay memory. Further, scaling down the amplitude of the first delay tap to zero and scaling up the amplitude of the second delay tap occurs over a limited transition time.

These and other features and advantages of the present invention are described below with reference to the drawings.

DETAILED DESCRIPTION OF PREFERRED EMBODIMENTS

Reference will now be made in detail to preferred embodiments of the invention. Examples of the preferred embodiments are illustrated in the accompanying drawings. While the invention will be described in conjunction with these preferred embodiments, it will be understood that it is not intended to limit the invention to such preferred embodiments. On the contrary, it is intended to cover alternatives, modifications, and equivalents as may be included within the spirit and scope of the invention as defined by the appended claims. In the following description, numerous specific details are set forth in order to provide a thorough understanding of the present invention. The present invention may be practiced without some or all of these specific details. In other instances, well known mechanisms have not been described in detail in order not to unnecessarily obscure the present invention.

It should be noted herein that throughout the various drawings like numerals refer to like parts. The various drawings illustrated and described herein are used to illustrate various features of the invention. To the extent that a particular feature is illustrated in one drawing and not another, except where otherwise indicated or where the structure inherently prohibits incorporation of the feature, it is to be understood that those features may be adapted to be included in the embodiments represented in the other figures, as if they were fully illustrated in those figures. Unless otherwise indicated, the drawings are not necessarily to scale. Any dimensions provided on the drawings are not intended to be limiting as to the scope of the invention but merely illustrative.

Figure 1:
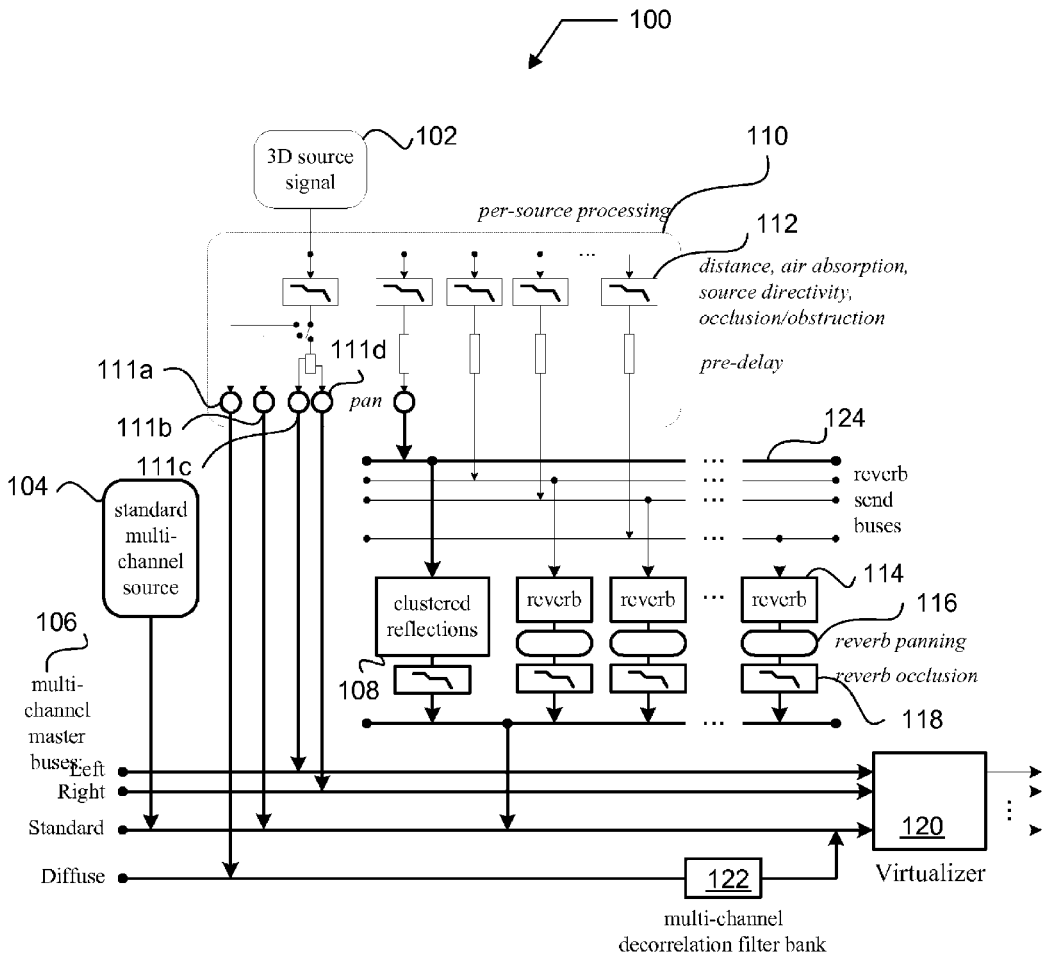
FIG. 1 is a diagram illustrating an overview of a complete spatialization engine, in accordance with one embodiment of the present invention.

FIG. 1 is a diagram illustrating an overview of a complete spatialization engine, in accordance with one embodiment of the present invention. FIG. 1 describes a multi-channel spatialization engine. A 3D source signal 102 feeds at least one of the directional encoders 111*a*-111*d*. Each of the directional encoders feeds one of the multi-channel master buses 106. The directional encoder 11*a* feeds a diffuse multichannel mixing bus which feeds a multi-channel decorrelation filter bank 122. The output of the multi-channel decorrelation filter bank 122 may be fed directly to an array of loudspeaker outputs, or, indirectly, as illustrated in FIG. 1, to a virtualizer 120 for binaural reproduction over headphones.

Figure 2:
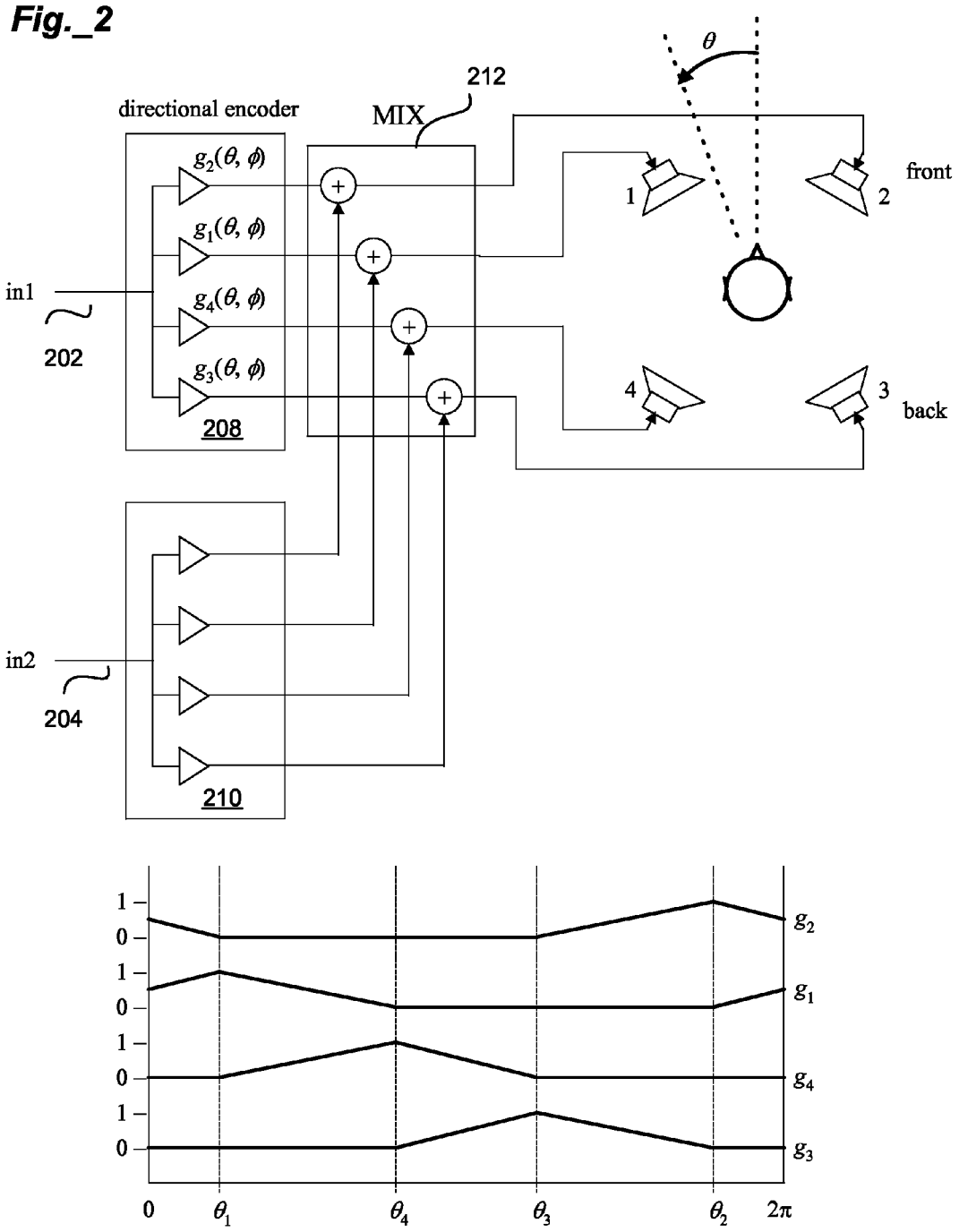
FIG. 2 is a diagram illustrating a standard multi-channel directional encoder, in accordance with one embodiment of the present invention.

FIG. 2 describes two 3D source signals 202 and 204. Each 3D source signal is processed by a directional encoder (208 and 210). Each directional encoder pans an input signal over a plurality of output channels to generate a first multi-channel directionally encoded signal. The multichannel directionally encoded signals are combined additively into a master bus 212 which directly feeds an array of loudspeaker outputs. Each directional encoder (208) performs a panning operation by scaling the input signal using amplitude scalers denoted gi. The values of the scalers gi are determined by the desired panning direction θ.

Figure 3:
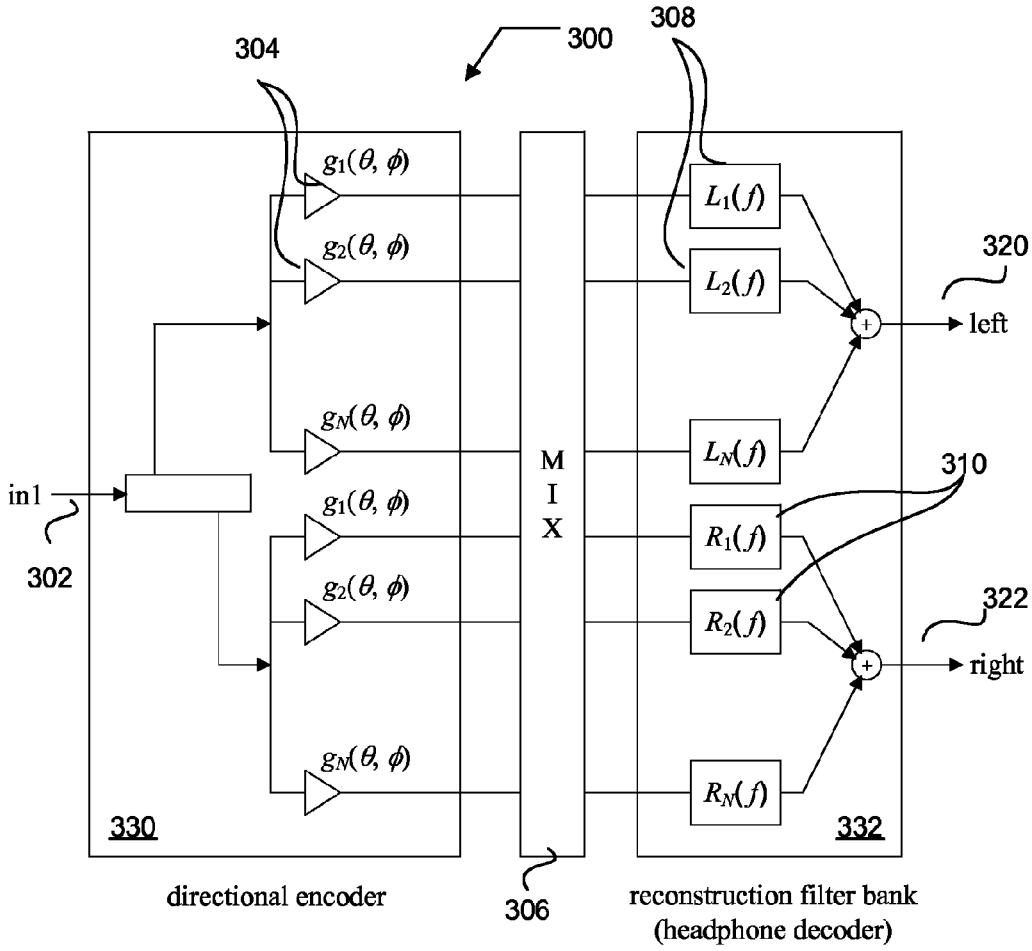
FIG. 3 is a diagram illustrating a binaural multi-channel directional encoder, in accordance with one embodiment of the present invention.

FIG. 3 is a diagram illustrating a binaural multi-channel directional encoder, in accordance with one embodiment of the present invention. A 3D source signal 302 is fed to a delay line where it is split into a left signal and a right signal. Each of the left signal and the right signal feeds a multi-channel directional encoder to generate a left multichannel directionally encoded signals and a right multichannel directionally encoded signal into a multi-channel binaural mixing bus 306. The multi-channel binaural mixing bus feeds a reconstruction filter bank where the individual channel signals are filtered by a set of HRTF filters 308 and combined to produce a left output channel 320 and a right output channel 322.

Figure 4:
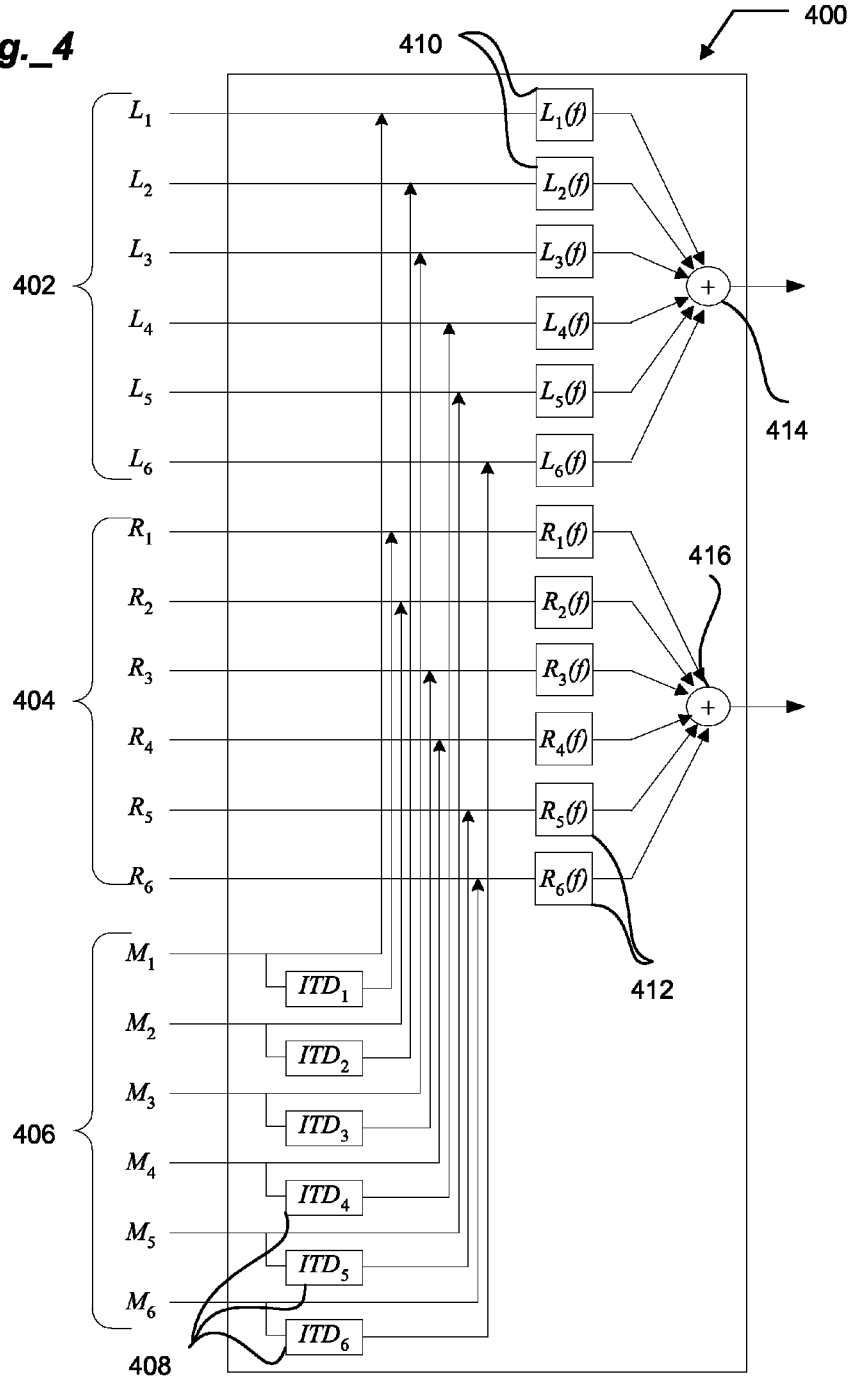
FIG. 4 is a diagram illustrating a hybrid multi-channel binaural virtualizer for including additional input bus in standard multi-channel format, in accordance with one embodiment of the present invention.

FIG. 4 is a diagram illustrating a hybrid multi-channel binaural virtualizer 400 corresponding generally to the virtualizer 120 illustrated in FIG. 1, in accordance with one embodiment of the present invention. The virtualizer 400 processes the left and right multichannel mixing bus signals 402 and 404 in a manner similar to the virtualizer 332. In addition, it receives the standard multi-channel mixing bus 406, and feeds them to the set of HRTF filters 410 after inserting delays 408 to synthesize the interchannel delays corresponding to each of the virtual loudspeaker positions.

Figure 5:
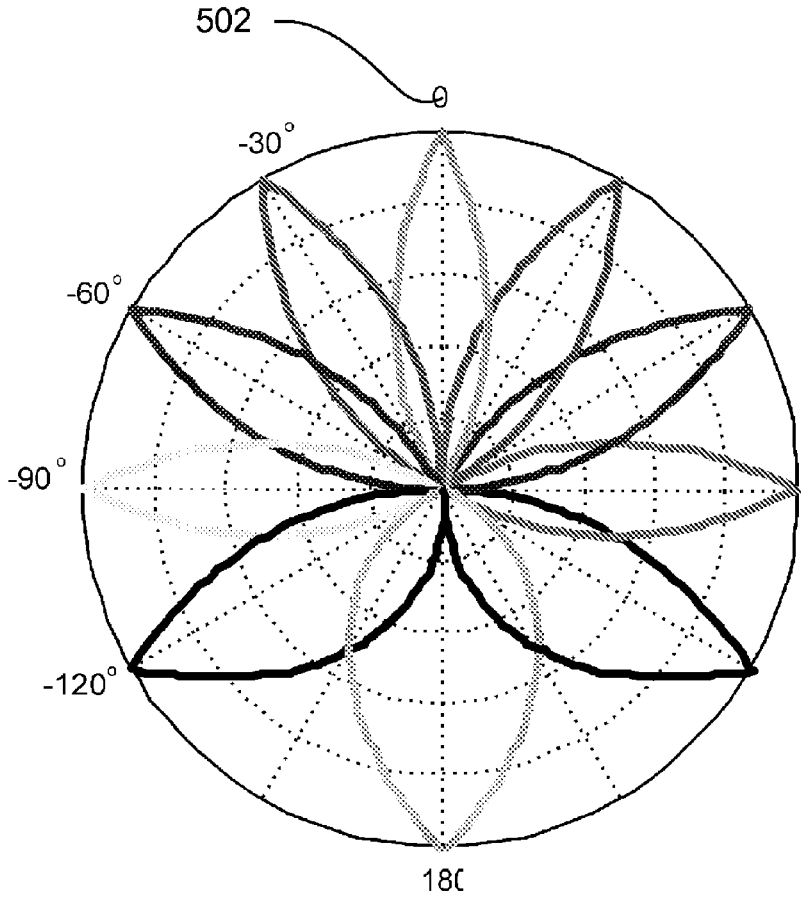
FIG. 5 is a diagram illustrating the panning functions of a multi-channel directional encoder, in accordance with one embodiment of the present invention.

FIG. 5 is a diagram illustrating the panning functions of a multi-channel directional encoder, in accordance with one embodiment of the present invention. The set of N-channel spatial panning functions {gi(*, *), i=0, 1, . . . N−1} is considered 'discrete' if, for any direction (*, *), there are at most three non-zero panning functions and if, for each panning function gi, there is a 'principal direction' (*i, *i) where this panning function reaches its maximum value and is the only non-zero panning function in the set. Discrete panning functions are computationally advantageous because they minimize the number of non-zero panning weights necessary to synthesize any given direction with the directional encoder of FIG. 2 or FIG. 3. FIG. 5 shows an example of discrete multi-channel horizontal-only amplitude-preserving panning functions obtained by the VBAP method for the principal direction azimuths {0, ±30, ±60, ±90, ±120, 180 degrees}.

Figure 6:
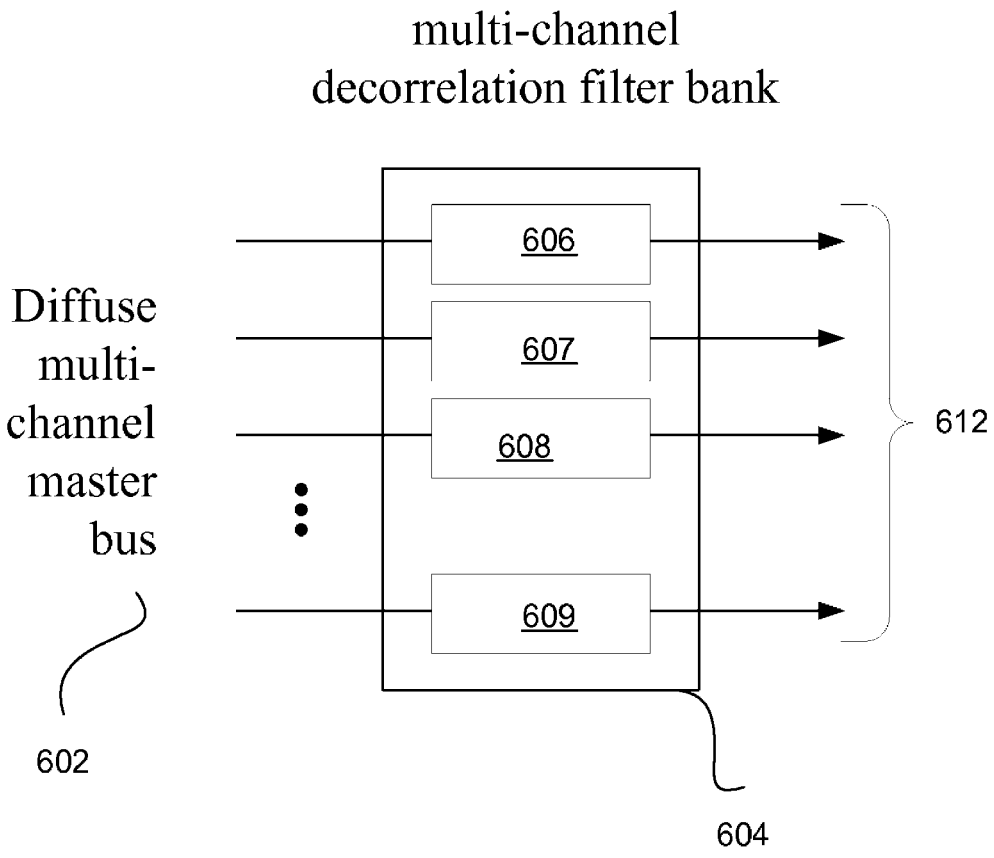
FIG. 6 is a diagram illustrating a multi-channel decorrelation filter bank, in accordance with one embodiment of the present invention.

FIG. 6 is a diagram illustrating a multi-channel decorrelation filter bank, in accordance with one embodiment of the present invention. The multi-channel filter bank 604 corresponds generally to block 122 illustrated in FIG. 1. The multi-channel 'diffuse' master bus feeds a multi-channel decorrelation filter bank (such that each channel of the bus feeds a different filter from the bank) while divergence panning is applied on a per-source basis for each spatially extended source. The output of the decorrelation filter bank is mixed into the standard multi-channel bus before virtualization. As illustrated, input signals are received over the diffuse multi-channel bus 602 and filtered by filters 606-609 to decorrelate them. The decorrelated output signals 612 are then fed into the standard multi-channel bus 106 illustrated in FIG. 1.

Divergence Panning

Figure 7:
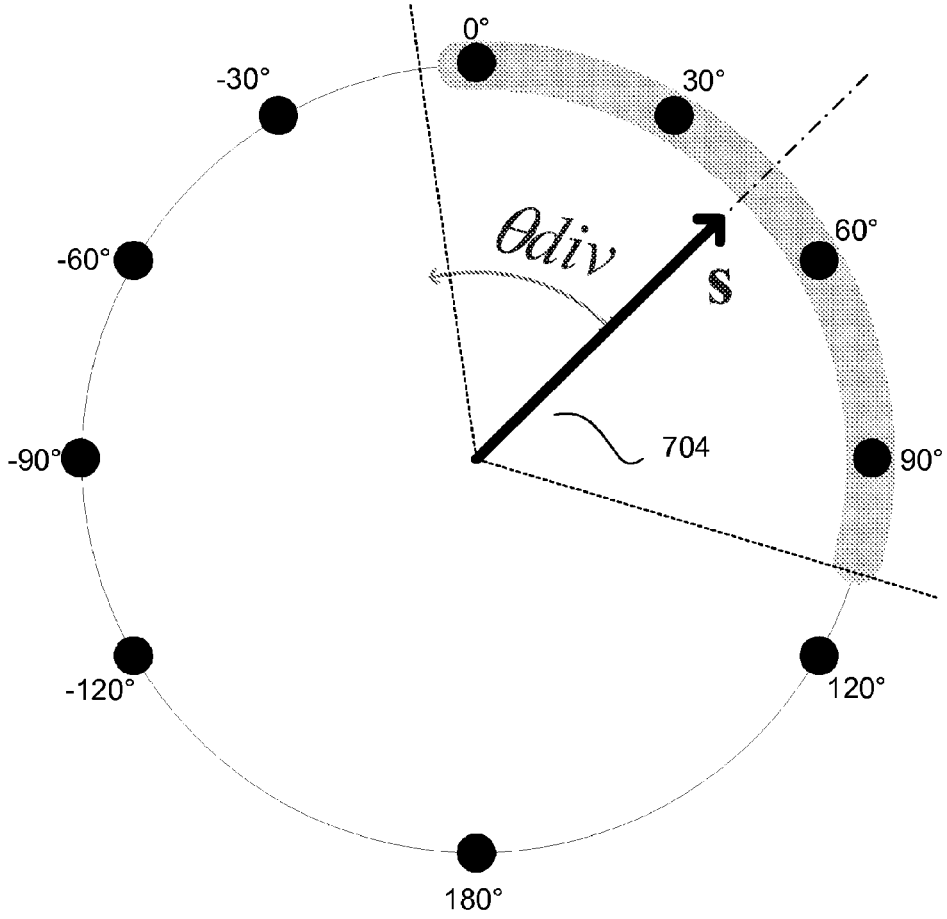
FIG. 7 is a diagram illustrating a divergence panning scheme in accordance with one embodiment of the present invention.

FIG. 7 is a diagram illustrating a divergence panning scheme in accordance with one embodiment of the present invention. The proposed spatialization engine employs a particular type of directional panning algorithm to control the spatial distribution of reverberation components and clustered reflections. In addition to reproducing a direction, this type of algorithm, referred to as 'divergence panning', controls the angular extent of a radiating arc centered around this direction. This is illustrated in FIG. 7 for the 2-D case. According to one embodiment, the value of the divergence angle θ div can vary from 0 (pinpoint localization) to π (diffuse localization).

A convenient alternative consists of representing the direction angle and the divergence angle together in the form of a panning vector whose magnitude is 1.0 for pinpoint localization and 0.0 for diffuse localization. This property is obtained if the panning vector, denoted s, is defined as the normalized integrated energy vector for a continuous distribution of sound sources on the radiating arc shown in FIG. 1, according to the formalism proposed by Gerzon:

$$\|s\| = \int_{[-\theta_{div}, \theta_{div}]} \cos(\theta) d\theta \Big/ \int_{[-\theta_{div}, \theta_{div}]} d\theta.$$

This yields the relation between the panning vector magnitude and the divergence angle θ div in 2D:

$$\|s\| = \sin(\theta_{div})/\theta_{div}.$$

The practical implementation of the divergence panning algorithm illustrated in FIG. 7 requires a method for deriving an energy scaling factor associated with each of the output channels. This can be achieved by modeling the radiating arc as a uniform distribution of notional sources with a total energy of 1.0, assigning discrete energy panning weights to each of these notional sources and summing the panning weight contributions of all these sources to derive the desired energy scaling factor for this channel. This method can be readily extended to three dimensions (e.g. by considering an axis-symmetric distribution of sources around the point located at direction (θ, φ) on the 3-D sphere).

Spatially Extended Sources

In accordance with an embodiment of the present invention, a new method for simulating spatially extended sound sources is provided. This allows simulating a spatially extended ("volumetric") sound source for a computational cost comparable to that incurred by a normal (point) source. This will be valuable for any implementation of this feature on resource constrained platforms. The only known alternative solutions uses typically 2 or 3 point sources to simulate a volumetric source and requires a per-source dynamic decorrelation algorithm which does not map well to some current audio processors.

In the architecture of FIG. 1, a multi-channel 'diffuse' master bus feeds a multi-channel decorrelation filter bank (such that each channel of the bus feeds a different filter from the bank) while divergence panning is applied on a per-source basis for each spatially extended source, using a directional encoder as illustrated in FIG. 2 (block 208), where the scaling factors are computed to realize divergence panning. The output of the decorrelation filter bank is mixed into the standard multi-channel bus before virtualization.

This new technique offers several advantages over existing spatially extended source simulation techniques: (1) the per-source processing cost for a spatially extended source is significantly reduced, becoming comparable to that of a point source spatialized in multi-channel binaural mode; (2) the desired spatial extent (divergence angle) can be reproduced precisely regardless of the shape of the object to be simulated; and (3) since the decorrelation filter bank is common to all sources, its cost is not critical and it can be designed without compromises. Ideally, it consists of mutually orthogonal all-pass filters. Alternatively, it can be based on synthetic quasi-colorless reverberation responses.

ITD Synthesis

Figure 8:
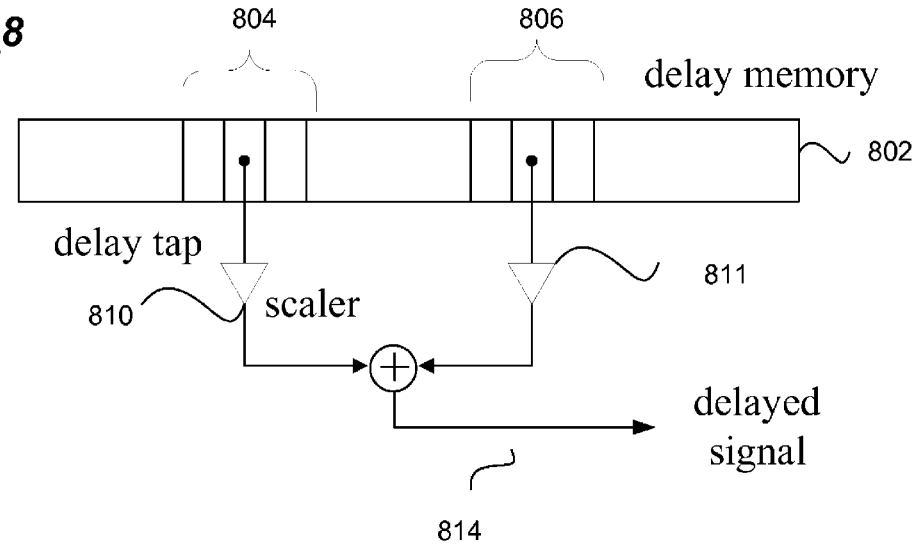
FIG. 8 is a diagram illustrating the implementation of an ITD synthesis module in accordance with one embodiment of the present invention.

FIG. 8 is a diagram illustrating the implementation of an ITD synthesis module in accordance with one embodiment of the present invention.

A computationally efficient method for synthesizing inter-aural time delay (ITD) cues is provided. This method allows the implementation of a time-varying ITD with no audible artifacts and without using costly fractional delay filter techniques. A computationally efficient ITD implementation is obtained by recognizing that:

(1) The simulation of a static arbitrary direction will be satisfactory even if the ITD value is rounded to the nearest integer number of samples, provided that the sample rate be sufficiently high. At a sample rate of 48 kHz, for instance, a difference of 0.5 sample on the ITD (the worst-case rounding error) corresponds approximately to an azimuth difference of 1.5 degrees, which is considered imperceptible.

(2) When the position of the virtual source needs to be updated, spectral inaccuracies occurring during the transition to a new position will not be noticeable if this transition is of short enough duration. Therefore, the transition can be implemented by simple cross-fading between two delay taps or by a time-varying delay implementation using first order linear interpolation.

Conventional technology would also incur significant additional processing cost per source due to costly fractional delay filter techniques, i.e., fractional delay implementation using FIR interpolator or variable all-pass filter).

In practice, it is simpler to introduce the ITD on the contra-lateral path only, leaving the ipsi-lateral path un-delayed. Individual adaptation of the ITD according to the morphology of the listener may be achieved approximately by adjusting the value of the spherical head radius r in Equation (8) or via a more elaborate model.

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A method for simulating a spatially extended sound source comprising:

panning a first input signal over a plurality of output channels to generate a first multi-channel directionally encoded signal;

panning a second input signal over the plurality of output channels to generate a second multi-channel directionally encoded signal;

combining the first and second multi-channel directionally encoded signals to generate a plurality of loudspeaker output channels; and applying a bank of decorrelation filters on the loudspeaker output channels, wherein at least one of the first input signal and the second input signal corresponds to the spatially extended sound source.

2. The method as recited in claim 1 wherein the plurality of loudspeaker output channels corresponds to at least one of real or virtual loudspeakers.

3. The method as recited in claim 1 wherein the panning comprises deriving an energy scaling factor associated with each of the output channels.

4. The method as recited in claim 3 wherein the spatially extended source comprises a plurality of notional elementary sources and the energy scaling factor is derived from the summation of contributions of at least one notional elementary source.

5. The method as recited in claim 4 wherein the notional sources having discrete panning weights assigned to them and the summation combines the panning weight contributions of the sources.

6. The method as recited in claim 1 wherein at least one of the decorrelation filters is one of an all-pass filter, a reverberation filter, a finite impulse response filter, an infinite impulse response filter, and a frequency-domain processing filter.

7. The method as recited in claim 1 wherein at least a first and a second of the decorrelation filters have weakly correlated responses.

8. The method as recited in claim 1 wherein a spatially extended sound source is represented as a combination of a direction and a divergence angle.

* * * * *